US011344764B2

(12) United States Patent
Wang

(10) Patent No.: US 11,344,764 B2
(45) Date of Patent: May 31, 2022

(54) WEIGHT TRAINING DEVICE

(71) Applicant: LIVEN SPORTS MFG. (Xiamen) Co., Ltd., Xiamen (CN)

(72) Inventor: Jen-Hung Wang, Taipei (TW)

(73) Assignee: LIVEN SPORTS MFG. (XIAMEN) CO., LTD., Xiamen (CN)

( * ) Notice: Subject to any disclaimer, the term of this patent is extended or adjusted under 35 U.S.C. 154(b) by 246 days.

(21) Appl. No.: 16/787,365

(22) Filed: Feb. 11, 2020

(65) Prior Publication Data

US 2021/0244994 A1 Aug. 12, 2021

(51) Int. Cl.
*A63B 21/075* (2006.01)
*A63B 21/00* (2006.01)
*A63B 21/072* (2006.01)

(52) U.S. Cl.
CPC ..... *A63B 21/075* (2013.01); *A63B 21/0728* (2013.01); *A63B 21/4035* (2015.10)

(58) Field of Classification Search
CPC ..... A63B 21/0728; A63B 21/075; A63B 21/4035
See application file for complete search history.

(56) References Cited

U.S. PATENT DOCUMENTS 4,076,236 A * 2/1978 Ionel ..... A63B 21/0602 482/106
4,566,690 A * 1/1986 Schook ..... A63B 21/0728 482/106
5,464,379 A * 11/1995 Zarecky ..... A63B 21/0728 482/106
7,563,208 B1 * 7/2009 Chen ..... A63B 21/0728 482/108
7,942,792 B1 * 5/2011 Wyman ..... A63B 21/0728 482/93
8,002,678 B1 * 8/2011 Krull ..... A63B 21/0728 482/93
8,858,406 B2 * 10/2014 Klukas ..... A63B 15/00 482/108
9,149,680 B2 * 10/2015 Thompson ..... A63B 21/4035
11,052,276 B1 * 7/2021 Baker ..... A63B 71/0036
11,185,731 B2 * 11/2021 Wang ..... A63B 21/075
2003/0096683 A1 * 5/2003 Fenelon ..... A63B 21/0601 482/107

(Continued)

*Primary Examiner* — Joshua Lee
(74) *Attorney, Agent, or Firm* — Muncy, Geissler, Olds & Lowe, PC

(57) ABSTRACT

A weight training device, comprising a holding element, a first counterweight element, and a first fastening element. The holding element has a locking member on one end, and one side of the holding element is provided with at least one first upper positioning member. The first counterweight element has a first locking member and a first position limiting slot on one end, wherein the first locking member is for locking the locking member of the holding element. One end of the first fastening element is position limited in the first position limiting slot in an elastic manner, and another end of the first fastening element has a first stopper for fixing the first upper positioning member to prevent a relative rotation between the holding element and the first counterweight element, so that a stable connection can be formed between the holding element and the first counterweight element for easy use, and the safety use can be ensured.

9 Claims, 5 Drawing Sheets

(56) References Cited

U.S. PATENT DOCUMENTS

| | | | | |
|---|---|---|---|---|
| 2007/0135274 | A1* | 6/2007 | Blateri | A63B 21/075 482/109 |
| 2010/0120589 | A1* | 5/2010 | Krull | A63B 21/075 482/93 |
| 2010/0190619 | A1* | 7/2010 | Chen | A63B 21/0728 482/108 |
| 2011/0263392 | A1* | 10/2011 | Yu | A63B 21/072 482/93 |
| 2012/0252641 | A1* | 10/2012 | Odneal | A63B 21/0728 482/108 |
| 2017/0259103 | A1* | 9/2017 | Simonetti | A63B 21/0624 |
| 2018/0117387 | A1* | 5/2018 | Wang | A63B 21/072 |
| 2018/0169460 | A1* | 6/2018 | Chen | A63B 21/075 |
| 2019/0240526 | A1* | 8/2019 | Owusu | A63B 21/4035 |
| 2019/0344114 | A1* | 11/2019 | Tran | A63B 21/4035 |
| 2020/0360757 | A1* | 11/2020 | Flick | A63B 21/075 |

* cited by examiner

WEIGHT TRAINING DEVICE

FIELD OF THE INVENTION

The present invention relates to a weight training device like a dumbbell, kettlebell, or barbell, and more particular to a weight training device that can stably combine two interlocking articles for easy use and the safety use can be ensured.

BACKGROUND OF THE INVENTION

For a common fitness device on the market, such as a bike exercise equipment, arm training device, etc., the purchasing cost is high and the size is huge, and therefore these devices are not suitable for use in an ordinary family. While for a weight training device, such as a dumbbell, kettlebell, or barbell, the size is small, the storage is easy, the purchasing cost is not high, the usage is not space restricted, and multiple body parts can do weight training, so that the body training can be done anytime. Therefore, the weight training device has become one of the commonly used fitness devices for ordinary people.

Except by iron casting, a general weight training device can also be made in one piece by cement hardening in a blow-molded plastic mold of a specific shape. Whereas, the overall volume and weight are fixed and cannot be replaced according to the personal need. As a result, not only the device cannot be custom-made for achieving adequate effect of sport and exercise, but also it is required to purchase separate device to fit the need at different time, which increases the purchase cost. Currently; there is a weight training device having a structure of at least one counterweight element stacked in series by locking. The number of the counterweight elements can be increased or decreased according to the personal need, and therefore adequate effect of sport and exercise can be achieved and the purchase cost can be saved.

SUMMARY OF THE INVENTION

However, in a practical use, the weight training device comprising plural counterweight elements stacked in series by locking has the problem that the locking structure may be loosened. It is not only inconvenient, but also it has the concern of safety use. In view of this, in order to provide a structure different from prior art and to improve the above disadvantages, the inventor has continuously researched to develop the present invention.

An object of the present invention is to provide a weight training device to solve the problems that the stacked counterweight elements of a conventional weight training device become loose easily during use by providing a fastening element respectively between the interlocking holding element and the first counterweight element and the interlocking first counterweight element and the second counterweight element, so that stable connection can be formed between the neighboring holding element and the first counterweight element and between the neighboring first counterweight element and the second counterweight element for easy use, and the safety use can be ensured.

In order to achieve the above object, the present invention provides a weight training device, comprising a holding element, a first counterweight element, and a first fastening element. The holding element has a locking member on one end, and one side of the holding element is provided with at least one first upper positioning member. The first counterweight element has a first locking member and a first position limiting slot on one end, wherein the first locking member is for locking the locking member of the holding element. One end of the first fastening element is position limited in the first position limiting slot in an elastic manner, and another end of the first fastening element has a first stopper for fixing the first upper positioning member to prevent a relative rotation between the holding element and the first counterweight element.

In implementation, a first lower positioning member is provided on one side of the first counterweight element, the first lower positioning member and the first position limiting slot are connected to each other, and the first lower positioning member vertically corresponds to the first upper positioning member for positioning the two sides of the first stopper, respectively.

In implementation, the first stopper is a ring.

In implementation, plural first upper positioning members are provided to the holding element, and the plural first upper positioning members are arranged spaced on one side of the holding element.

In implementation, the first position limiting slot comprises a first slot and a first tunnel, and a first block portion is provided between the first slot and the first tunnel, so that one end of the of the first fastening element is position limited by the first slot and the first stopper on another end of the first fastening element is position limited in the first tunnel.

In implementation, the weight training device of the present invention further comprises a first cover covering the first slot for limiting the position of one end of the first fastening element.

In implementation, the first fastening element comprises a stick and a spring; one end of the stick is provided with a head, and another end of the stick connects the first stopper; the spring is put on the stick, and two ends of the spring respectively press against the head and the first block portion, so that one end of the first fastening element is position limited in the first position limiting slot in an elastic manner.

In implementation, another end of the first counterweight element is provided with a first locking member, and one side of the first counterweight element is provided with at least one second upper positioning member.

In implementation, the weight training device of the present invention further comprises a second counterweight element and a second fastening element. The second counterweight element has a second locking member and a second position limiting slot on one end, wherein the second locking member is for locking the first locking member of the first counterweight element. One end of the second fastening element is position limited in the second position limiting slot in an elastic manner, and another end of the second fastening element has a second stopper for fixing the second upper positioning member to prevent a relative rotation between the first counterweight element and the second counterweight element.

In implementation, a second lower positioning member is provided on one side of the second counterweight element, the second lower positioning member and the second position limiting slot are connected to each other, and the second lower positioning member vertically corresponds to the second upper positioning member for positioning the two sides of the second stopper, respectively.

The present invention will be understood more fully by reference to the drawings and detailed descriptions of the preferred embodiments below.

DETAILED DESCRIPTIONS OF PREFERRED EMBODIMENTS

Figure 1:
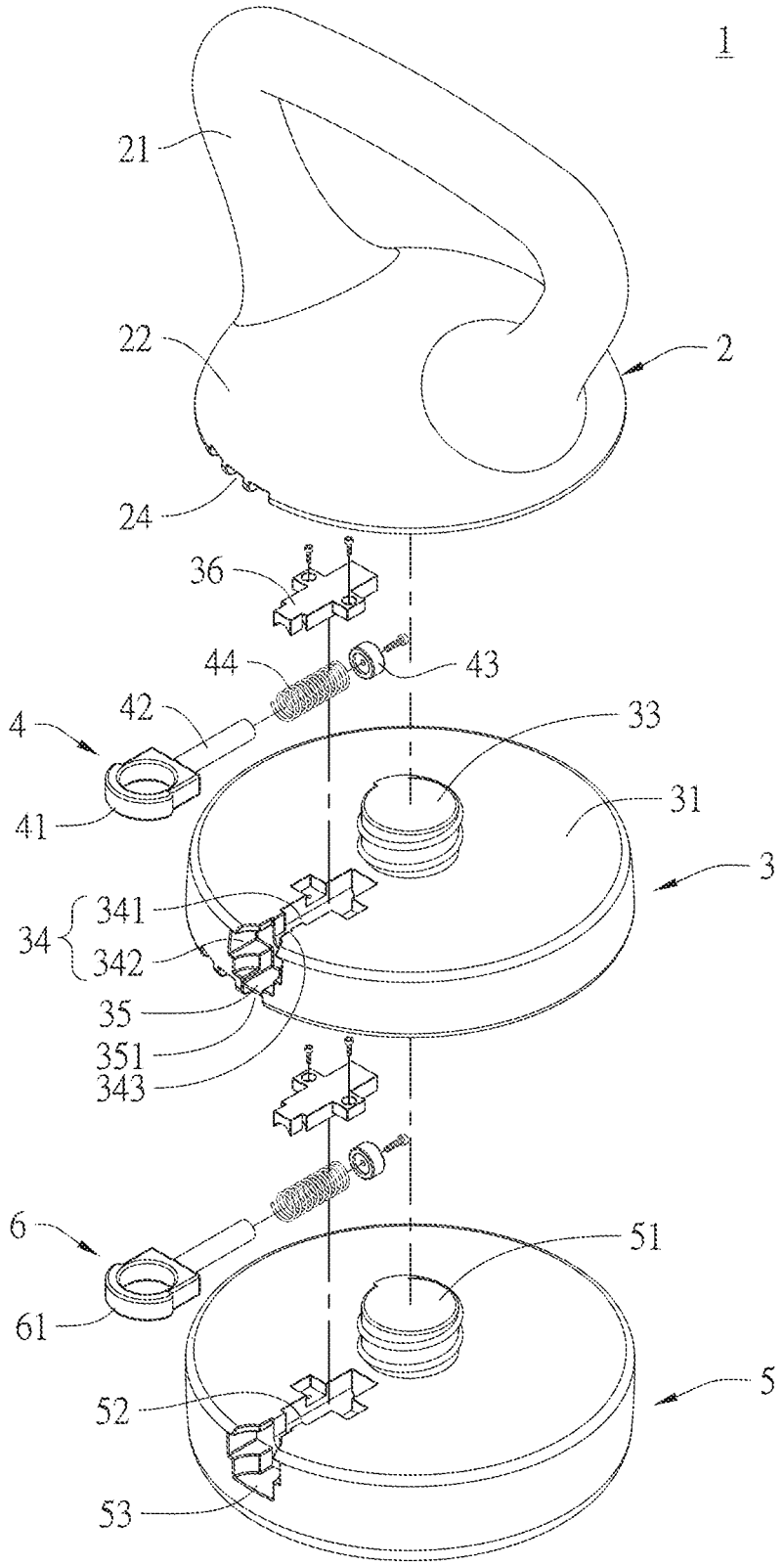
FIG. 1 is an exploded view of the preferred embodiment of the present invention.
Figure 2:
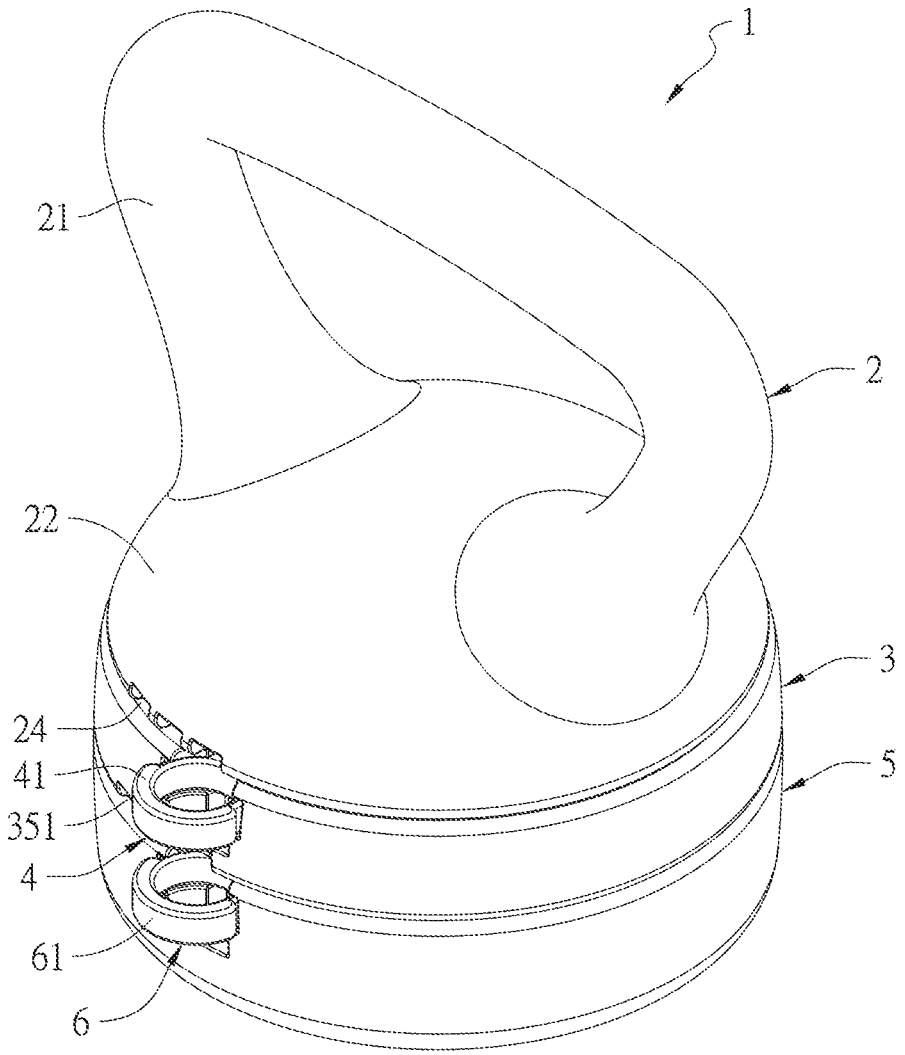
FIG. 2 is a perspective view of a preferred embodiment of the present invention.
Figure 3:
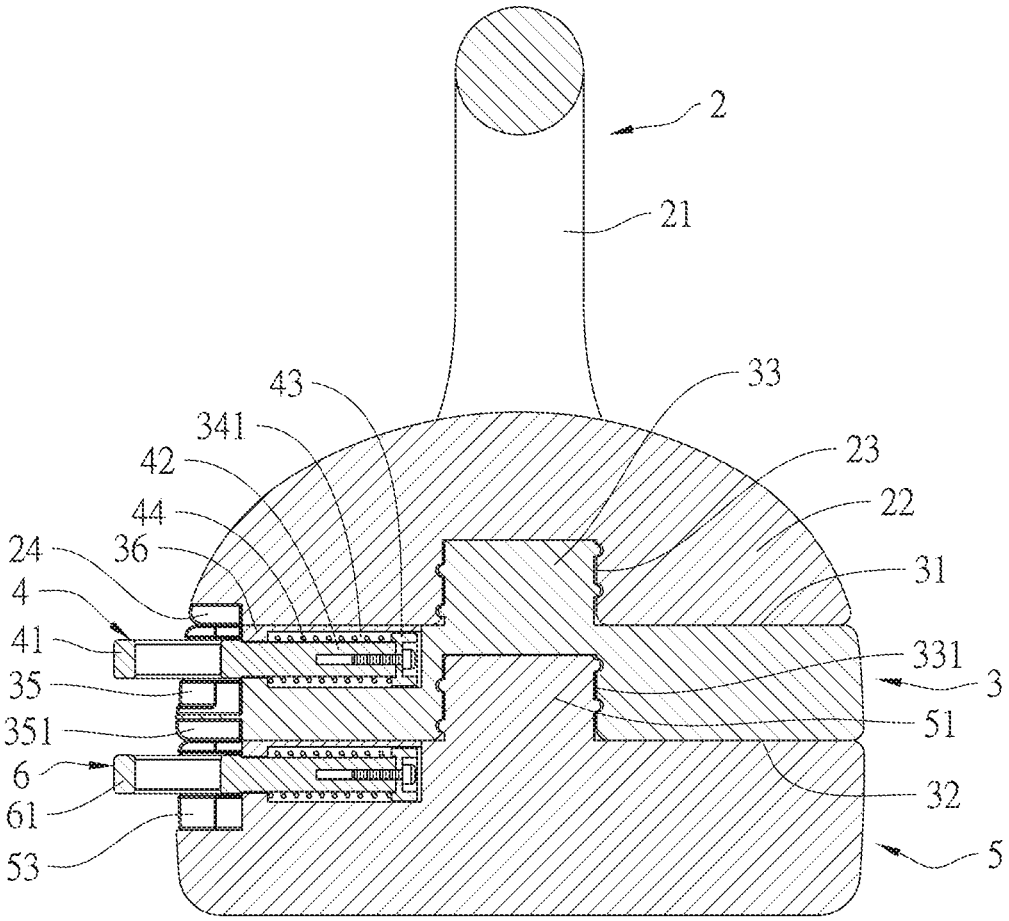
FIG. 3 is a cross-sectional view of the assembly of a preferred embodiment of the present invention.

The present invention is a weight training device, like a dumbbell, kettlebell, or barbell, mainly comprising a holding element, a first counterweight element, and a first fastening element. The holding element has a locking member on one end, and one side of the holding element is provided with at least one first upper positioning member. The first counterweight element has a first locking member and a first position limiting slot on one end, wherein the first locking member is for locking the locking member of the holding element. One end of the first fastening element is position limited in the first position limiting slot in an elastic manner, and another end of the first fastening element has a first stopper for fixing the first upper positioning member to prevent a relative rotation between the holding element and the first counterweight element.

Please refer to FIGS. 1-5, which show preferred embodiments of the weight training device 1 of the present invention. The present embodiment takes the kettlebell as an example, which sequentially comprises, in series, a holding element 2, a first counterweight element 3, a second counterweight element 5, a first fastening element 4 respectively fastening the holding element 2 and the first counterweight element 3, and a second fastening element 6 respectively fastening the first counterweight element 3 and the second counterweight element 5. The upper part of the holding element 2 is provided with a handle grip 21 for a user to hold. The lower part of the holding element 2 is provided with an arched convex bump 22 for connecting with the two ends of the handle grip 21. A depressed inner screw hole is located at the central position of the bottom surface of the arched convex bump 22, and the inner screw hole is as the locking member 23. One side of the periphery of the holding element 2 is provided with three spacedly arranged grooves as the first upper positioning members 24.

The first counterweight element 3 is a disc, which has a top surface 31 and a bottom surface 32 opposite to the top surface 31. An upwards-protruding screw rod is provided at the central position of the top surface 31 of the first counterweight element 3, and the screw rod is as the first locking member 33 for locking the locking member 23 thereabove on the bottom of the holding element 2. A depressed inner screw hole is located at the central position of the bottom surface 32 of the first counterweight element, and the inner screw hole is as the first locking member 331. Moreover, the top surface 31 of the first counterweight element 3 is provided with a downwards recessed first position limiting slot 34. The first position limiting slot 34 comprises an orthogonally connected first slot 341 and a first tunnel 342. Two bumps horizontally extending toward each other to form a spacer are provided between the first slot 341 and the first tunnel 342. The two bumps together are provided as a first block portion 343. One side of the first counterweight element has a recess, and the recess is as a first lower positioning member 35. Three spacedly arranged grooves are located below the first lower positioning member 35, and the grooves are as the second upper positioning members 351. The first lower positioning member 35 and the first tunnel 342 of the first position limiting slot 34 are vertically connected, and the first lower positioning member 35 corresponds to one of the first upper positioning members 24 thereabove on one side of the periphery of the holding element 2 the. A first cover 36 is a long plate. The first cover 36 locks and connects the top surface 31 of the first counterweight element 3, so that the top face of the first cover 36 and the top surface 31 are on the same plane, and the bottom face of the first cover 36 covers the first slot 34 to form a rectangular receiving space.

Figure 4:
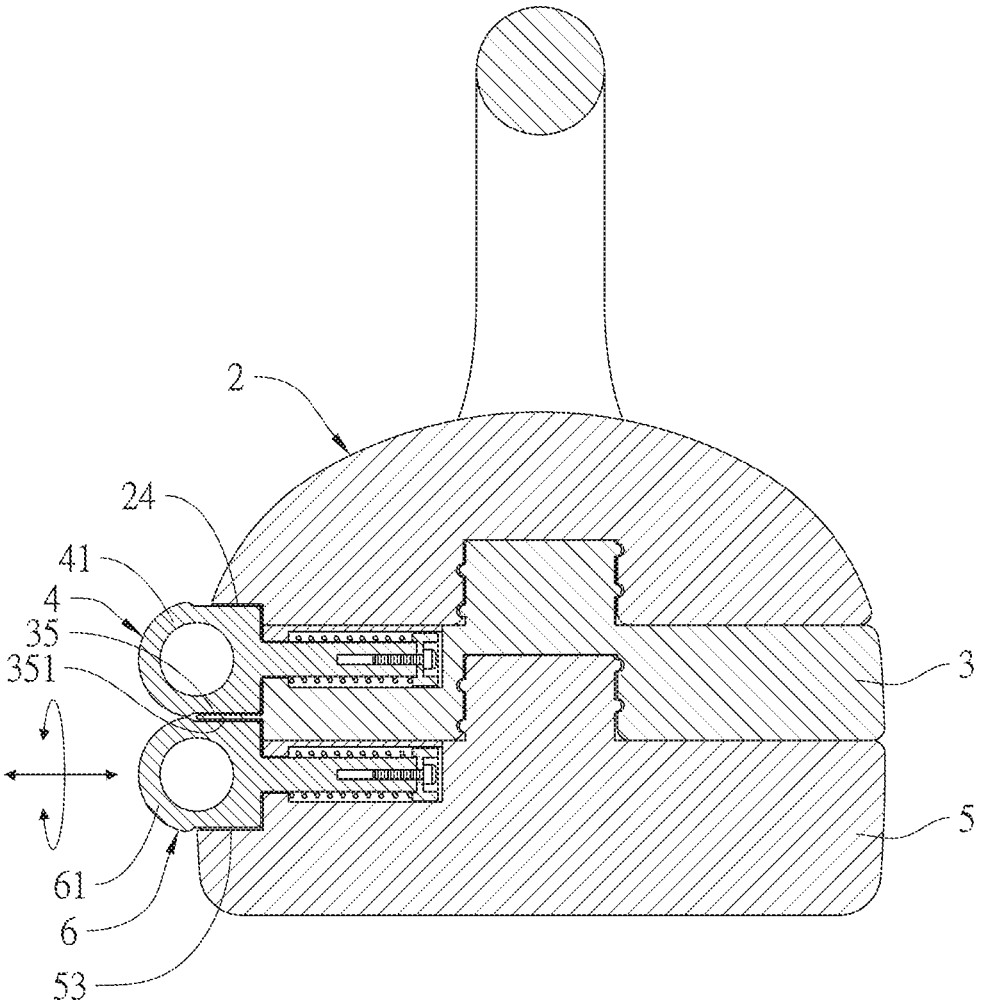
FIG. 4 is a cross-sectional view of the assembly of an in-use preferred embodiment of the present invention.
Figure 5:
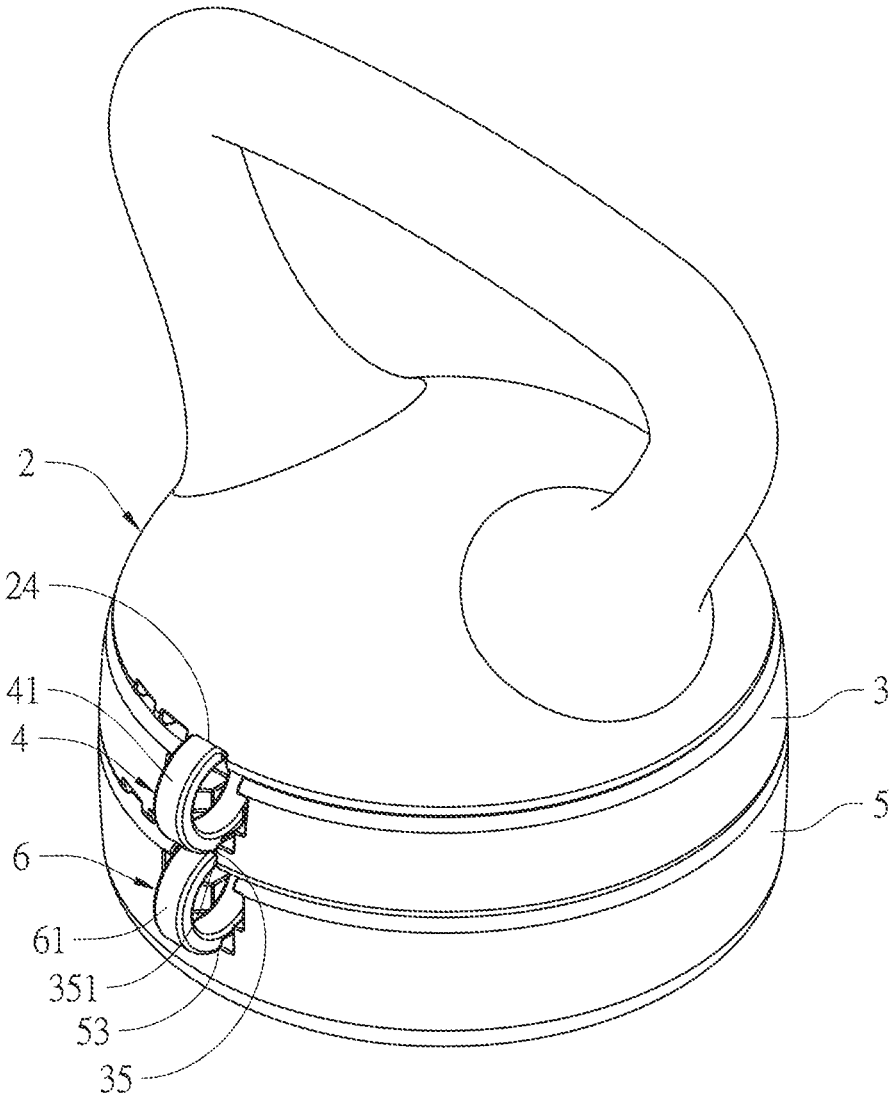
FIG. 5 is a perspective view of an in-use preferred embodiment of the present invention.

The first fastening element 4 comprises a first stopper 41, a stick 42, a head 43, and a spring 44. The first stopper 41 is a ring. One end of the stick 42 is connected to the head 43, and another end of the stick 42 is connected to the first stopper 41. The spring 44 is put on the stick 42. Two ends of the spring 44 respectively press against the head 43 and one side of the first block portion 343, so that one end of the first fastening element 4 is position limited in the first slot 341 of the first position limiting slot 34 in an elastic manner, and the first stopper 41 is position limited in the first tunnel 342. Thereby, as shown in FIGS. 4 and 5, when pulling the first stopper 41 by finger to draw out the first fastening element 4, the first fastening element 4 can be oriented by 90°, and after the first fastening element 4 bounces back, two sides of the first stopper 41 respectively fix the first upper positioning members 24 of the holding element 2 and the first lower positioning member 35 of the first counterweight element 3 to prevent the relative rotation of the holding element 2 and the first counterweight element 3.

In implementation, the main structure of the second counterweight element 5 and the first counterweight element 3 are the same, and the main structure of the second fastening element 6 and the first fastening element 4 are the same. The second counterweight element 5 has a second locking member 51 and a second position limiting slot 52 on the top surface 31. The second locking member 51 locks the first locking member 331 of the first counterweight element 3 thereabove. A second lower positioning member 53 is provided on one side of the periphery of the second counterweight element 5. The second lower positioning member 53 and the second position limiting slot 52 are vertically connected to each other, and the second lower positioning member 53 vertically corresponds to one of the second upper positioning member 351 on one side of the periphery of the first counterweight element 3. One end of the second fastening element 6 may be position limited in the second position limiting slot 52 in an elastic manner, and another end of the second fastening element 6 has a second stopper 61 for fixing the second upper positioning member 351 and the second lower positioning member 53 by two sides of the second stopper 61 after being drawn out, rotating, and returning to the original position to prevent a relative rotation between the first counterweight element 3 and the second counterweight element 5.

Therefore, the present invention has the following advantages:

1. The present invention connects the holding element, the first counterweight element, and the second counterweight element in series by locking. The interlocking holding element and the first counterweight element first fastening element are respectively positioned by the first fastening element provided therebetween, and the interlocking first counterweight element and the second counterweight element are respectively positioned by the second fastening element provided therebetween. Therefore, the holding element, the first counterweight element, and the second counterweight element do not become loose after assembling, which is not only convenient to manipulate, but also can ensure the safety of use.

2. The holding element of the present invention has plural first upper positioning members arranged spaced on one side of the periphery of the holding element, and the first counterweight element has plural second upper positioning members arranged spaced on one side of the periphery of first counterweight element. Therefore, as stacking and locking the holding element, the first counterweight element, and the second counterweight element with each other in series, one of the first upper positioning members or one of second upper positioning members can be chosen for positioning according to the actual locking condition to make the connection more suitable and stable.

Accordingly, according to the content disclosed above, the present invention can indeed meet its anticipated object of providing a weight training device, which can respectively connect and lock the holding element and every counterweight element stably without being loose, and therefore, it is convenient to manipulate and the safety of use can be ensured.

What is claimed is:

1. A weight training device, comprising:

a holding element, having a locking member on one end, and one side of the holding element provided with at least one first upper positioning member;

a first counterweight element, having a first upper locking member and a first position limiting slot on one end, wherein a first lower positioning member is provided on one side of the first counterweight element, the first lower positioning member is vertically corresponding to the first upper positioning member, the first lower positioning member and the first position limiting slot are connected to each other, and the first upper locking member is for locking the locking member of the holding element; and a first fastening element, one end thereof position limited in the first position limiting slot in an elastic manner, and another end thereof having a first stopper, wherein one side of the first stopper is for fixing the first upper positioning member and the other side of the first stopper is for fixing the first lower positioning member, so as to prevent a relative rotation between the holding element and the first counterweight element.

2. The weight training device according to claim 1, wherein the first stopper is a ring.

3. The weight training device according to claim 2, wherein plural first upper positioning members are provided to the holding element, and the plural first upper positioning members are arranged spaced on one side of the holding element.

4. The weight training device according to claim 1, wherein plural first upper positioning members are provided to the holding element, and the plural first upper positioning members are arranged spaced on one side of the holding element.

5. The weight training device according to claim 1, wherein the first position limiting slot comprises a first slot and a first tunnel, and a first block portion is provided between the first slot and the first tunnel, so that one end of the first fastening element is position limited by the first slot and the first stopper on another end of the first fastening element is position limited in the first tunnel.

6. The weight training device according to claim 5, further comprising a first cover covering the first slot for limiting a position of one end of the first fastening element.

7. The weight training device according to claim 5, wherein the first fastening element comprises a stick and a spring; one end of the stick is provided with a head, and another end of the stick is connected to the first stopper; the spring is arranged on the stick, and two ends of the spring respectively press against the head and the first block portion, so that one end of the first fastening element is position limited in the first position limiting slot in an elastic manner.

8. The weight training device according to claim 1, wherein another end of the first counterweight element is provided with a first lower locking member, and one side of the first counterweight element is provided with at least one second upper positioning member.

9. The weight training device according to claim 8, further comprising a second counterweight element and a second fastening element, the second counterweight element having a second locking member and a second position limiting slot on one end, wherein a second lower positioning member is provided on one side of the second counterweight element, the second lower positioning member vertically corresponds to the second upper positioning member, the second lower positioning member and the second position limiting slot are connected to each other, the second locking member is for locking the first lower locking member of the first counterweight element, and one end of the second fastening element is position limited in the second position limiting slot in an elastic manner, and another end of the second fastening element has a second stopper, one side of the second stopper is for fixing the second upper positioning member and the other side of the second stopper is for fixing the second lower positioning member, so as to prevent a relative rotation between the first counterweight element and the second counterweight element.

* * * * *